United States Patent [19]

Logas

[11] Patent Number: 4,986,584

[45] **Date of Patent: * Jan. 22, 1991**

[54] ELECTRICAL STRIKE RELEASE

[75] Inventor: Duane K. Logas, San Bernardino, Calif.

[73] Assignee: Adams Rite Manufacturing Company, City of Industry, Calif.

[ * ] Notice: The portion of the term of this patent subsequent to Apr. 17, 2007 has been disclaimed.

[21] Appl. No.: 435,673

[22] Filed: Nov. 13, 1989

Related U.S. Application Data

[63] Continuation of Ser. No. 288,774, Dec. 22, 1988, Pat. No. 4,917,425.

[51] Int. Cl.[5] ..... E05C 19/16

[52] U.S. Cl. ..... 292/341.16; 292/201

[58] Field of Search ..... 292/341.16, 201; 70/275, 277

[56] References Cited

U.S. PATENT DOCUMENTS

| | | | |
|---|---|---|---|
| 420,834 | 2/1890 | Seib . | |
| 1,949,850 | 3/1934 | Willard | 292/341.16 |
| 3,122,388 | 12/1964 | Powers . | |
| 3,183,027 | 5/1965 | Powers . | |
| 3,455,591 | 7/1969 | Powers . | |
| 3,543,547 | 12/1970 | Sugiyama | 292/341.16 |
| 3,638,984 | 1/1972 | Davidson . | |
| 3,640,560 | 2/1972 | Zawadzki et al. | 292/341.16 |
| 3,758,142 | 9/1973 | Gartner | 292/341.16 |
| 3,804,442 | 4/1974 | Powers . | |
| 3,861,727 | 1/1975 | Froerup et al. . | |
| 4,211,443 | 7/1980 | Butts et al. | 292/341.16 |
| 4,491,354 | 1/1985 | Williams . | |
| 4,626,010 | 12/1986 | Hanchett, Jr. et al. . | |
| 4,838,591 | 6/1989 | Fuss | 282/341.16 |
| 4,867,496 | 9/1989 | Thomas | 292/341.16 |

*Primary Examiner*—Eric K. Nicholson

*Attorney, Agent, or Firm*—William W. Haefliger

[57] ABSTRACT

An electrical release door strike includes: a carrier frame; a strike bolt carried by the frame for pivoting when released, allowing door opening, the bolt adapted to receive and resist door opening force prior to said pivoting; structure carried by the frame to release the strike bolt for such pivoting, including first, second and third arms; and the first arm movable from a first position blocking bolt pivoting to a second position allowing bolt pivoting to in turn allow door opening, the second arm movable from a primary position in which it holds the first arm in its first position to a secondary position in which it allows first arm movement to its second position, and the third arm movable from an initial position in which it holds the second arm in its primary position to a subsequent position in which it allows movement of the second arm to its secondary position.

3 Claims, 9 Drawing Sheets

FIG. 13.
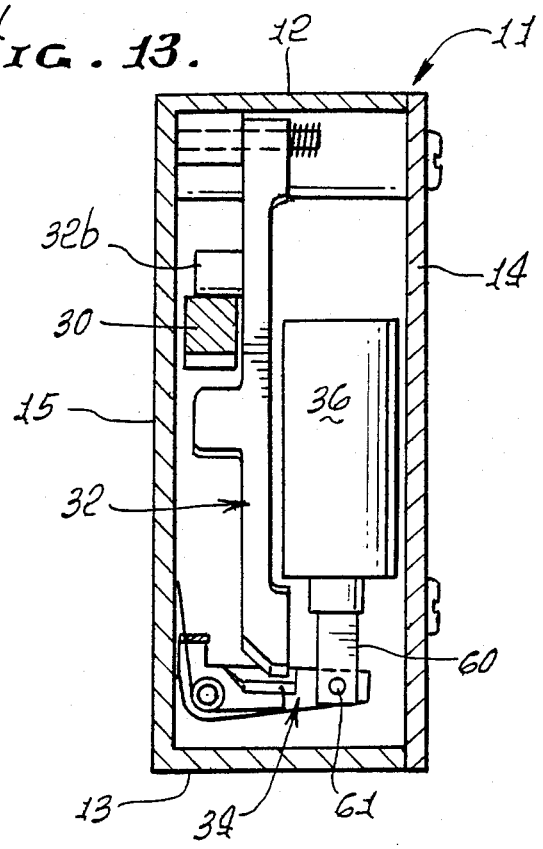
FIG. 15.
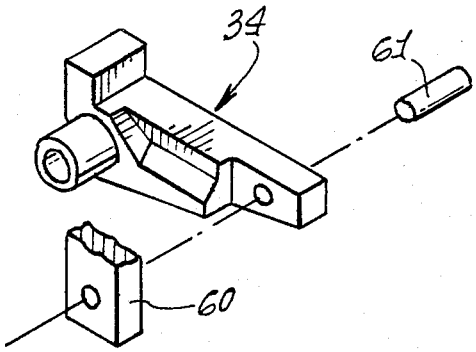
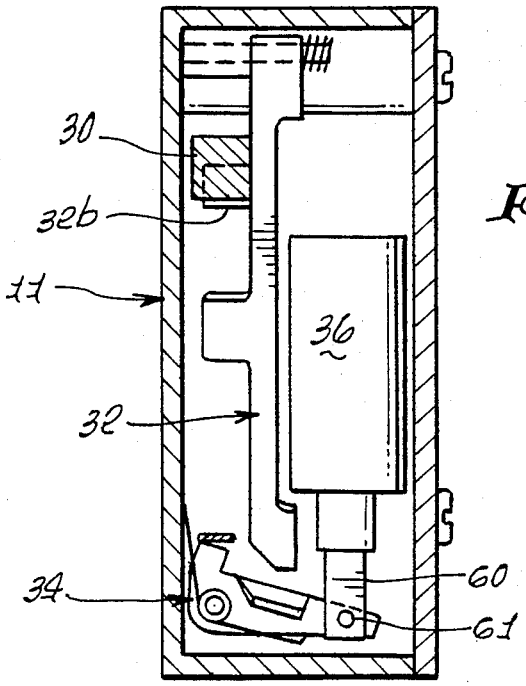
FIG. 14.

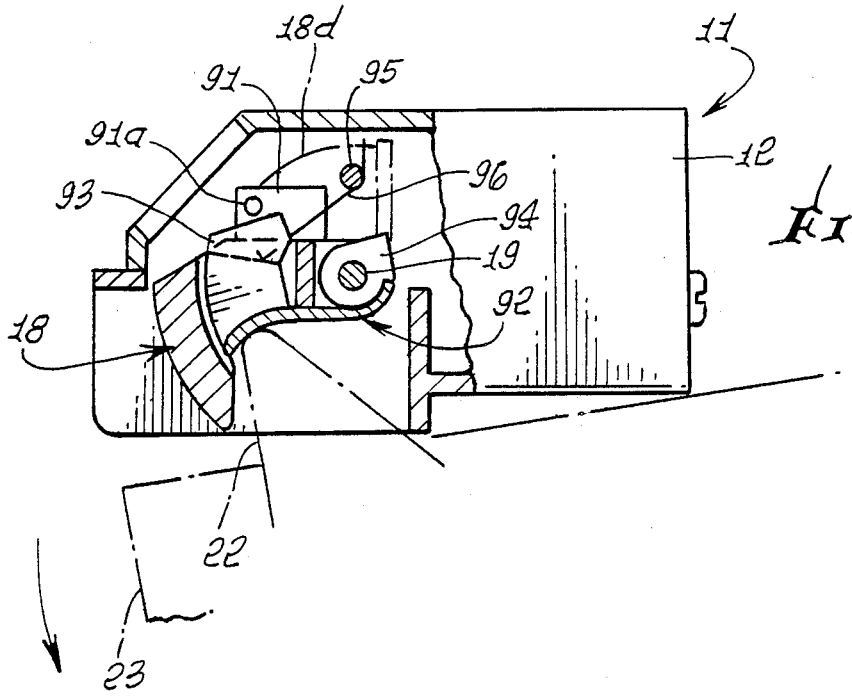
FIG. 18.
FIG. 19.
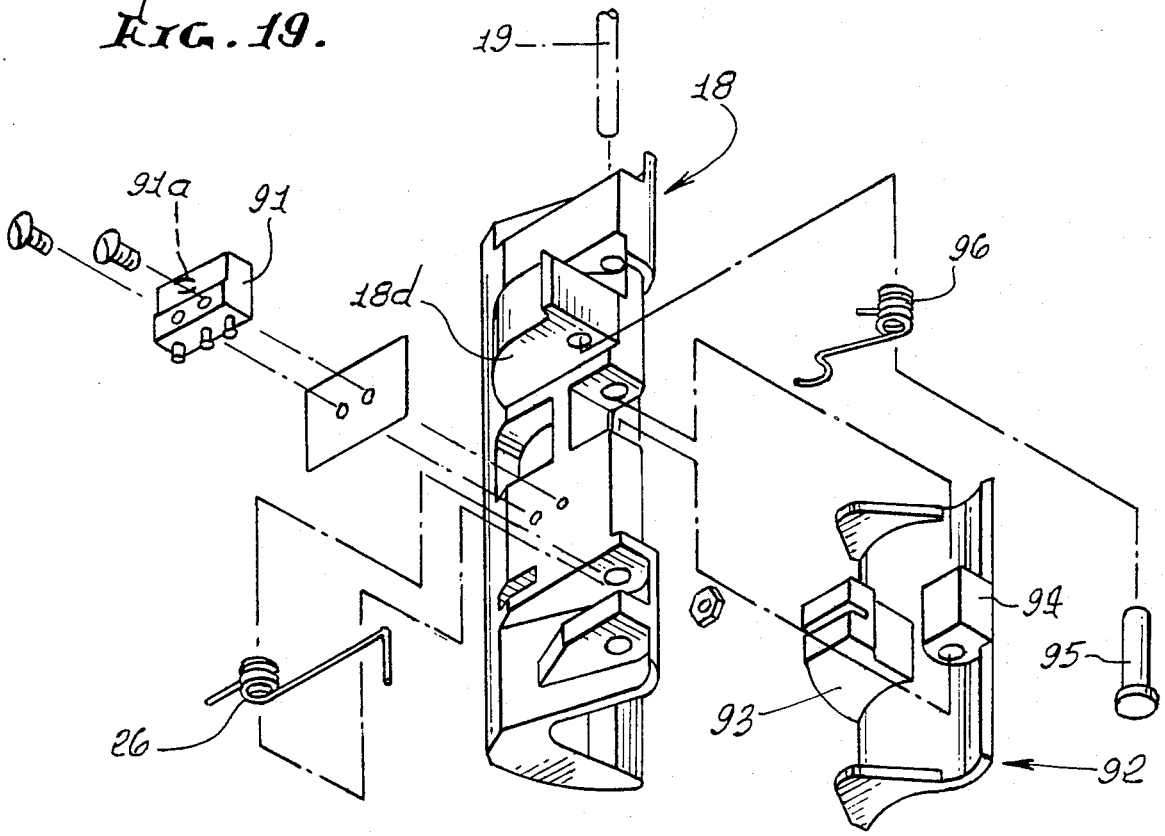

ELECTRICAL STRIKE RELEASE

This application is a continuation of Ser. No. 288,774 filed Dec. 22, 1988, U.S. Pat. No. 4917425.

BACKGROUND OF THE INVENTION

This invention relates generally to latches, and more particularly a fail-safe mechanism allowing a normally open door to be locked when a solenoid is energized. It also relates to a fail-secure mechanism operable to unlock a normally locked door when a solenoid is energized, and vice versa.

Devices heretofore available for the purpose or purposes described herein embody inherently undesirable features, which not only present potential sources of trouble, but also make them more difficult to install and maintain in good operating condition. One problem with such devices concerned the need for relatively large-sized or heavy-duty solenoids capable of exerting sufficient force to unlatch a door. There is need for a small size, compact, fail-safe mechanism wherein the operating solenoid need only produce a very small force to effect fail-safe latching of a normally open door, or to effect failure-secure unlatching of a normally locked door.

SUMMARY OF THE INVENTION

It is a major object of the invention to provide electrical release, door strike apparatus meeting the above need. Such apparatus, in accordance with the invention, is characterized by:

(a) a carrier frame, (b) a strike bolt carried by the frame for pivoting when released, allowing door opening, the bolt adapted to receive and resist door opening force prior to said pivoting, (c) means carried by the frame to release the strike bolt for such pivoting, including first, second and third arms, (d) the first arm movable from a first position blocking bolt pivoting to a second position allowing bolt pivoting to in turn allow said door opening, the second arm movable from a primary position in which it holds the first arm in said first position to a secondary position in which it allows first arm movement to said second position, and the third arm movable from an initial position in which it holds the second arm in said primary position to a subsequent position in which it allows movement of the second arm to said secondary position. The third arm may be movable by a solenoid in a fail-secure mechanism.

It is another object of the invention to provide an apparatus as referred to wherein:

(i) said bolt and said first arm have interengaged cam surfaces A and B, (ii) said first arm and said second arm have interengaged cam surfaces C and D.

Typically, the first arm has a pivot axis closer to said cam surfaces A and B than to said cam surfaces C and D, said first arm pivotable about its said pivot axis when it moves from said first to said second position. Also, the second and third arms may have interengaged blocking surfaces E and F. Surface A and B, C and D, and E and F are all relatively movable during operation of the device, as will be seen.

Yet another object of the invention is to provide force exerting means yieldably urging the third arm into its said initial position. Such force exerting means may advantageously comprise a torsion spring, and a counterweighted arm acting as a back-up to that torsion spring.

A further object is to provide a mechanism in which a solenoid armature is connected to the third arm to hold it in its initial position when the solenoid is energized, the armature adapted to drop to displace the third arm to its subsequent position in the event the solenoid becomes de-energized. Added objects include provision of a solenoid operated latch requiring solenoid operation (as from a remote location) to allow opening of the door; and the provision of a switch to signal the operator that the door is open.

These and other objects and advantages of the invention, as well as the details of an illustrative embodiment, will be more fully understood from the following specification and drawings, in which:

DRAWING SPECIFICATION

FIG. 13 is a section taken in elevation on lines 13—13 of FIG. 10;

FIG. 14 is a section taken in elevation on lines 14—14 of FIG. 12;

FIG. 15 is a perspective view of the trip arm seen in FIG. 13;

FIG. 18 is a view like FIG. 17, the device shown in unlocked condition;

FIG. 19 is an exploded perspective view of the elements of the device seen in FIG. 17.

DETAILED DESCRIPTION

Figure 1:
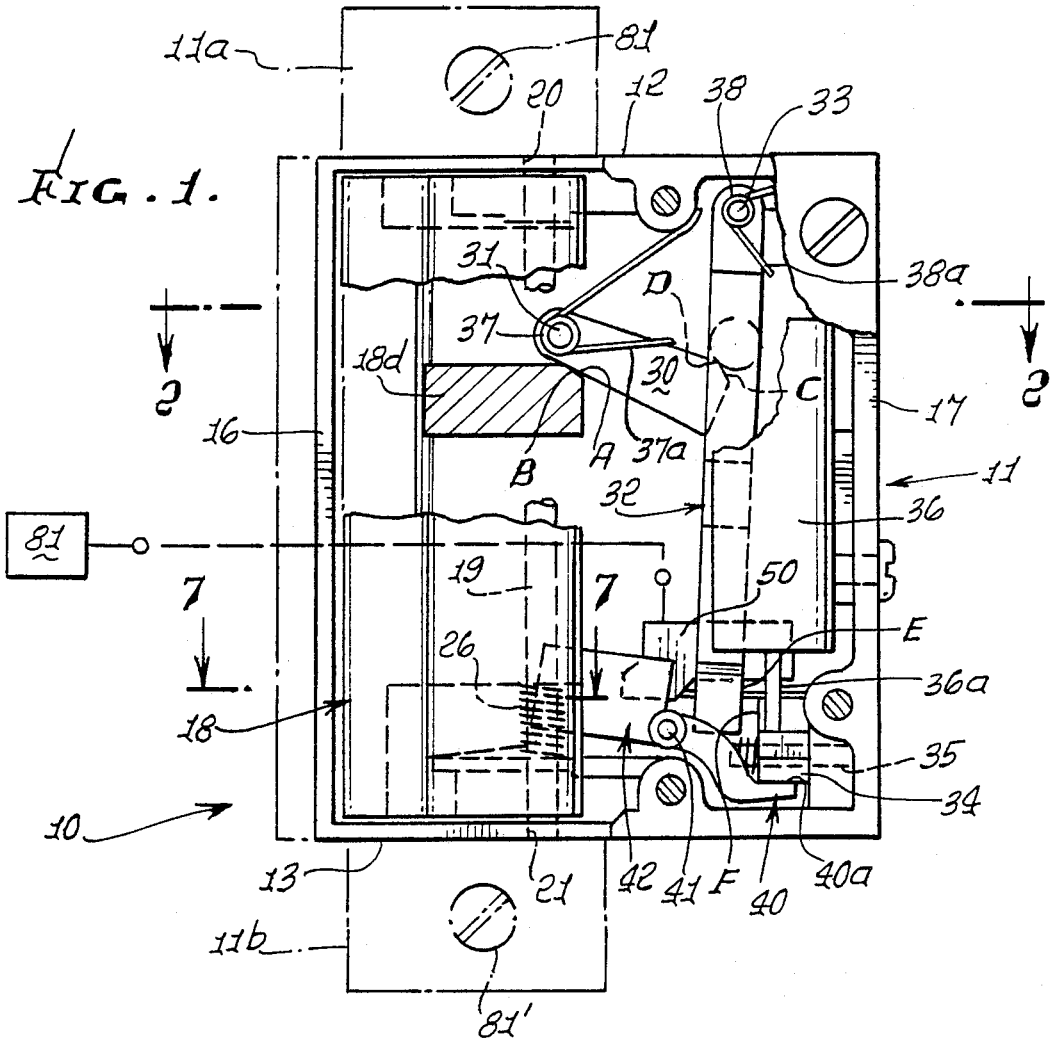
FIG. 1 is a side elevation taken through one form of the fail-secure device.
Figure 2:
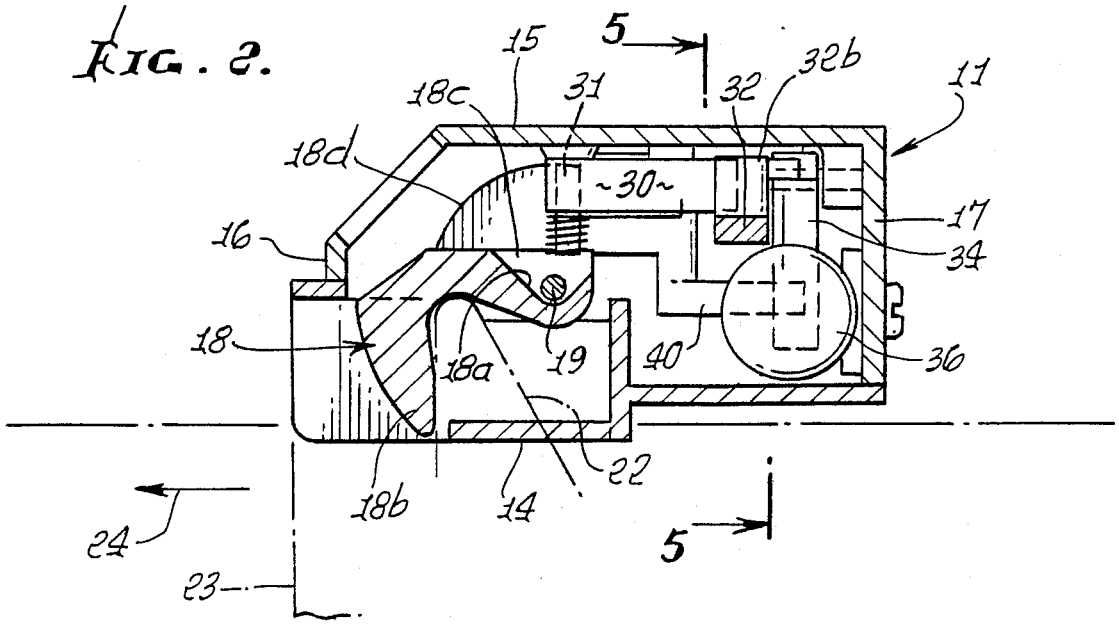
FIG. 2 is a horizontal section taken on lines 2—2 of FIG. 1.
Figure 4:
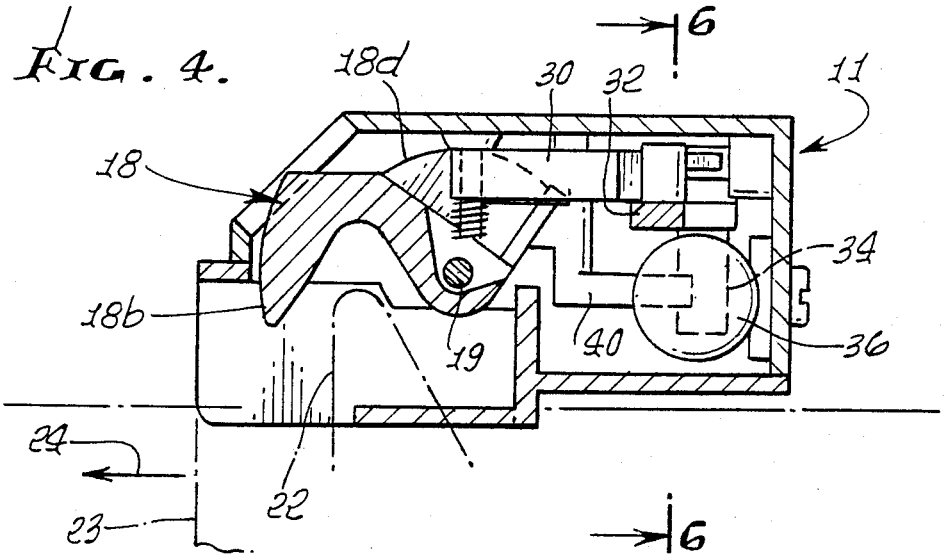
FIG. 4 is a horizontal section taken on lines 4—4 of FIG. 3.
Figure 8:
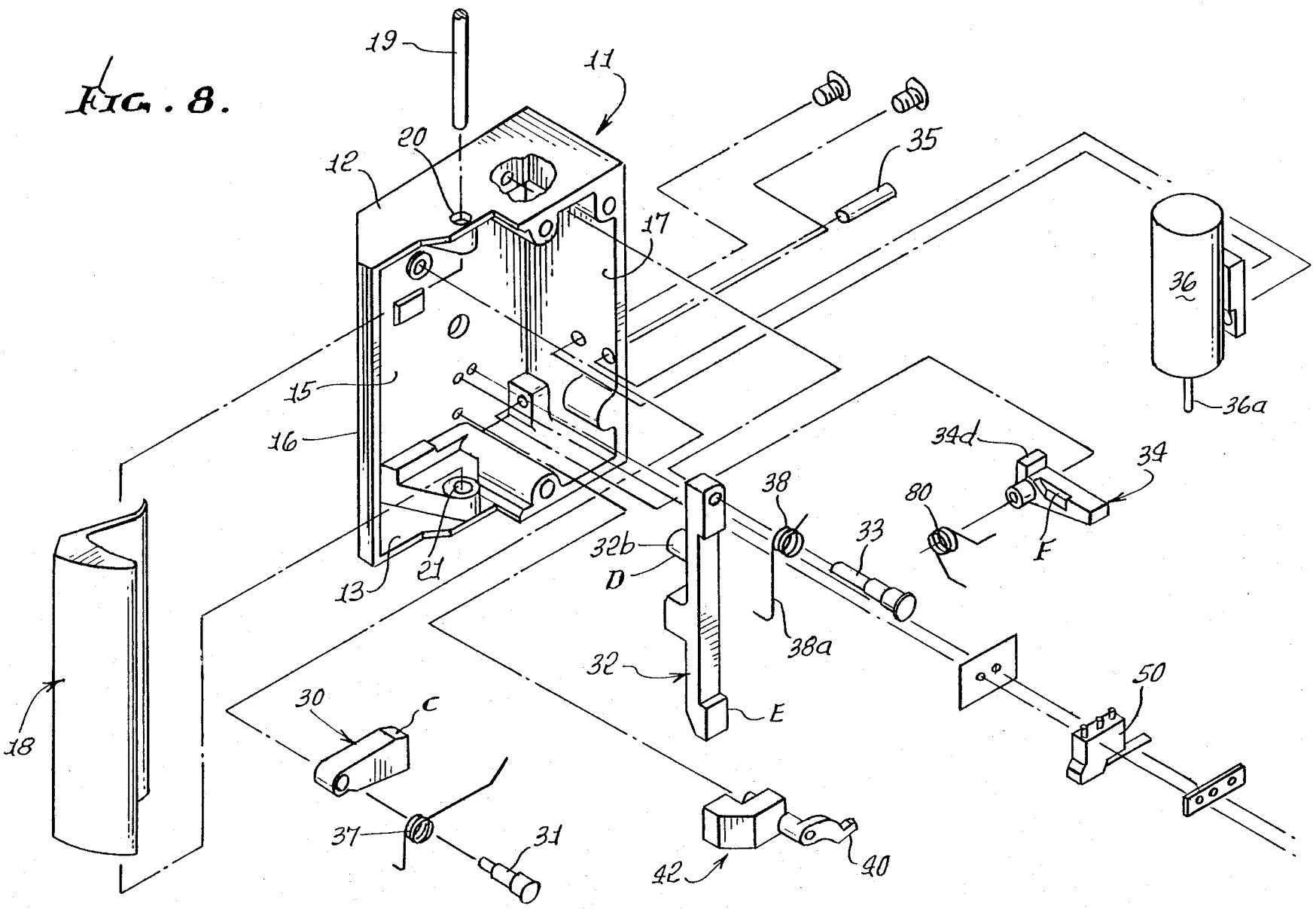
FIG. 8 is an exploded perspective view of the device seen in FIGS. 1-7.
Figure 9:
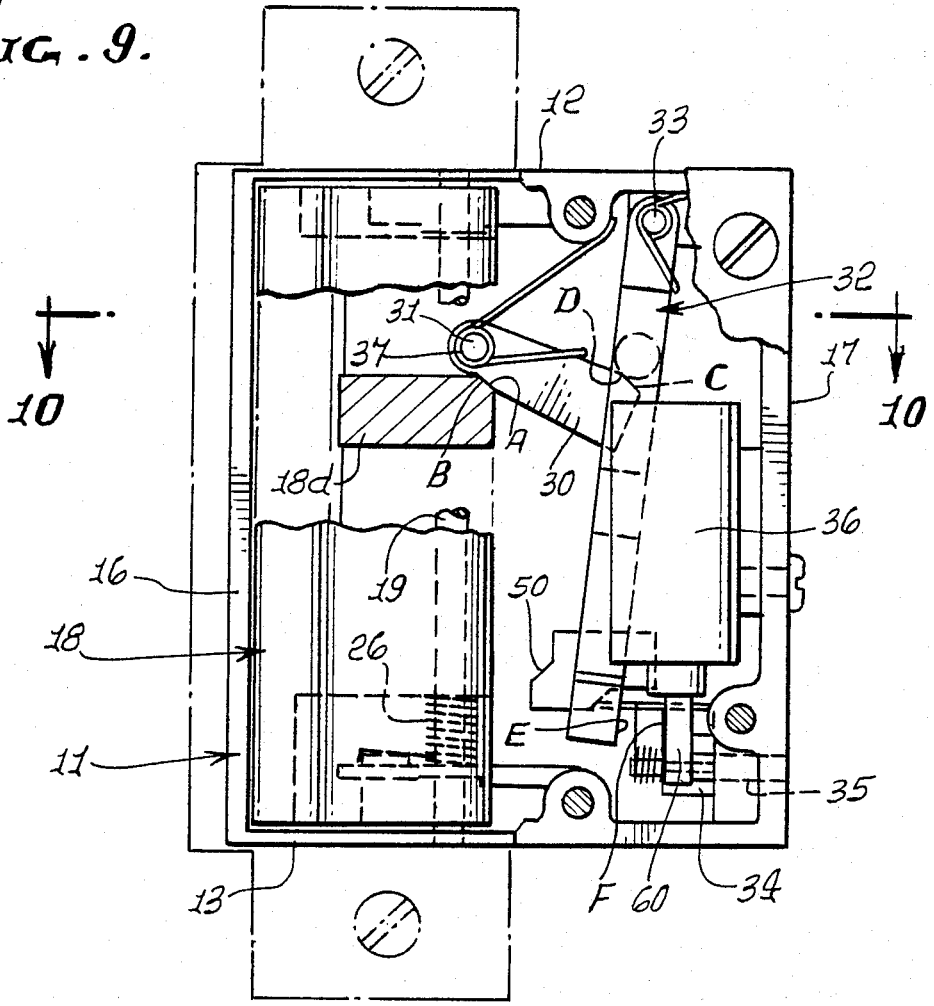
FIG. 9 is a view like FIG. 1 showing a modified device in locked condition.
Figure 10:
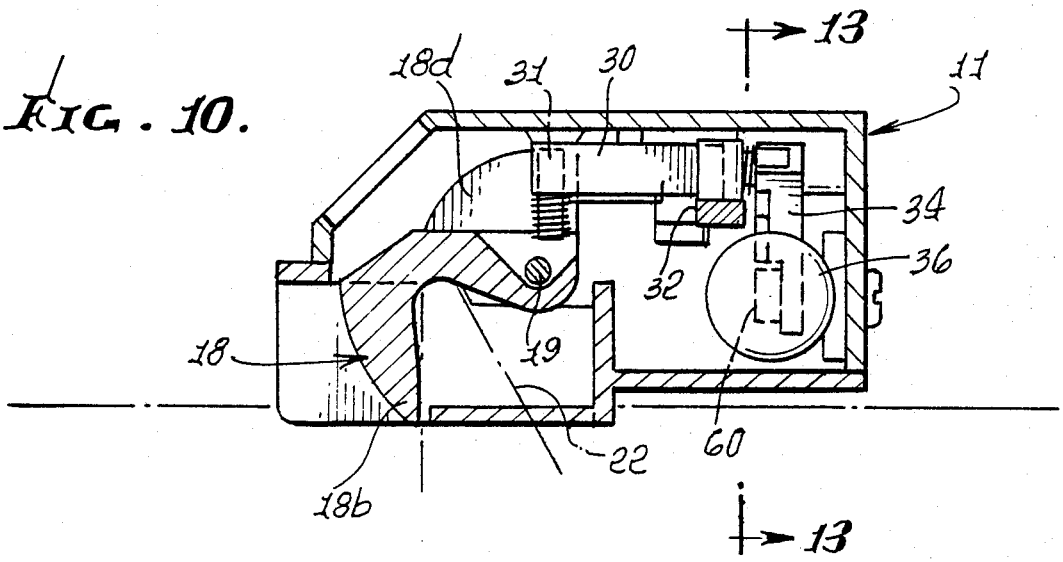
FIG. 10 is a horizontal section taken on lines 10—10 of FIG. 9.
Figure 11:
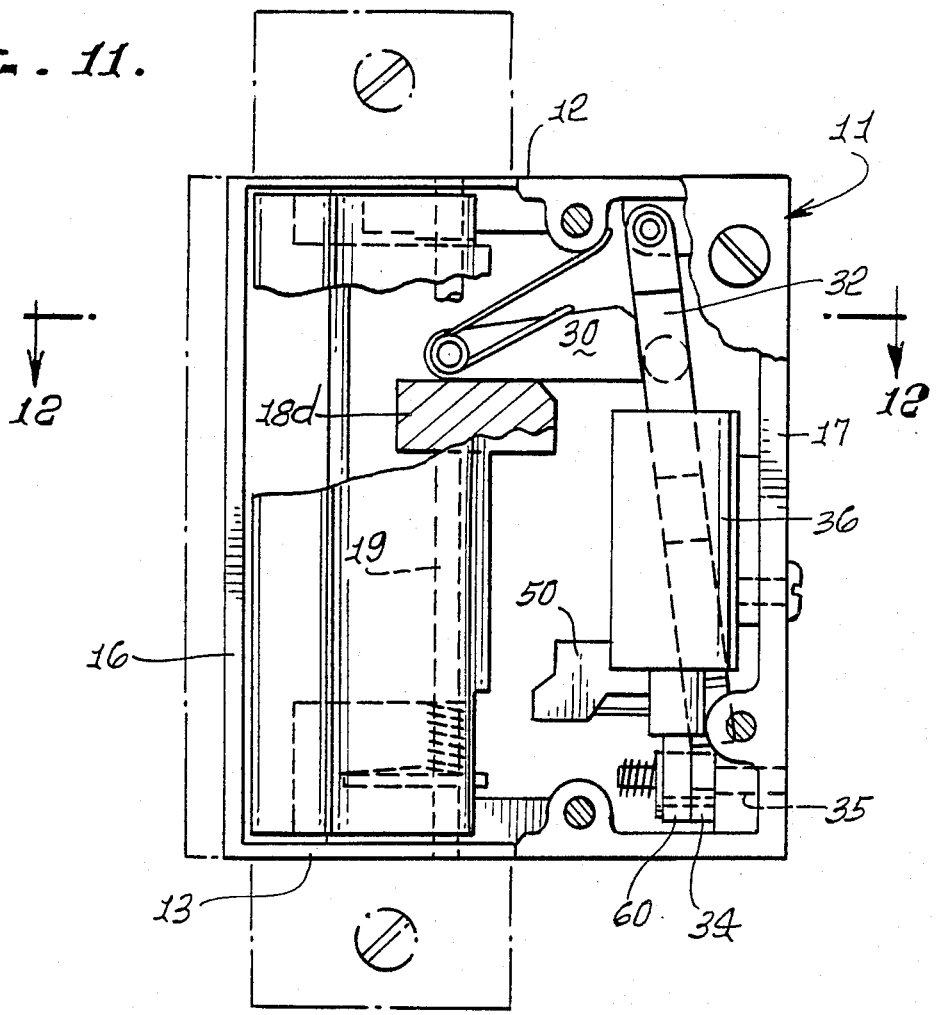
FIG. 11 is a view like FIG. 9 showing the device in unlocked condition.
Figure 12:
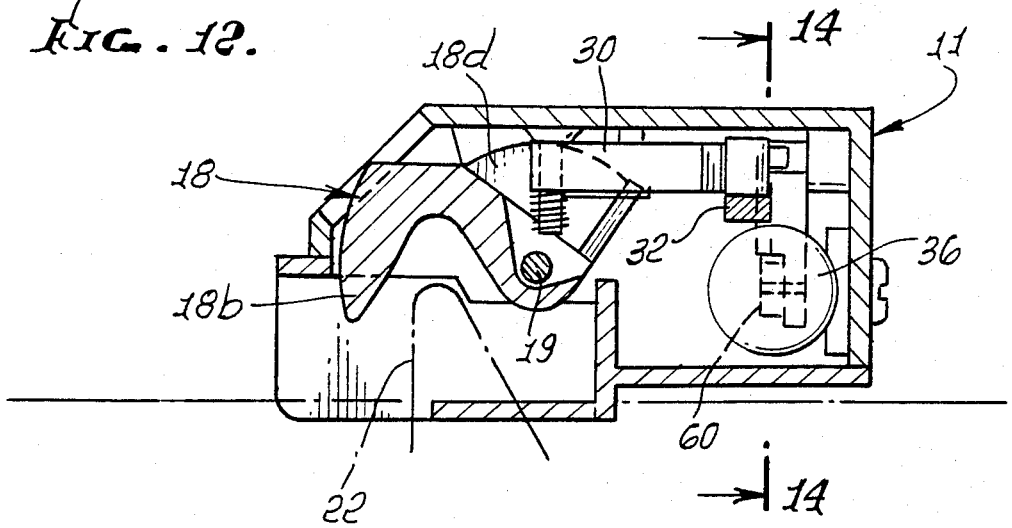
FIG. 12 is a horizontal section taken on lines 12—12 of FIG. 11.
Figure 16:
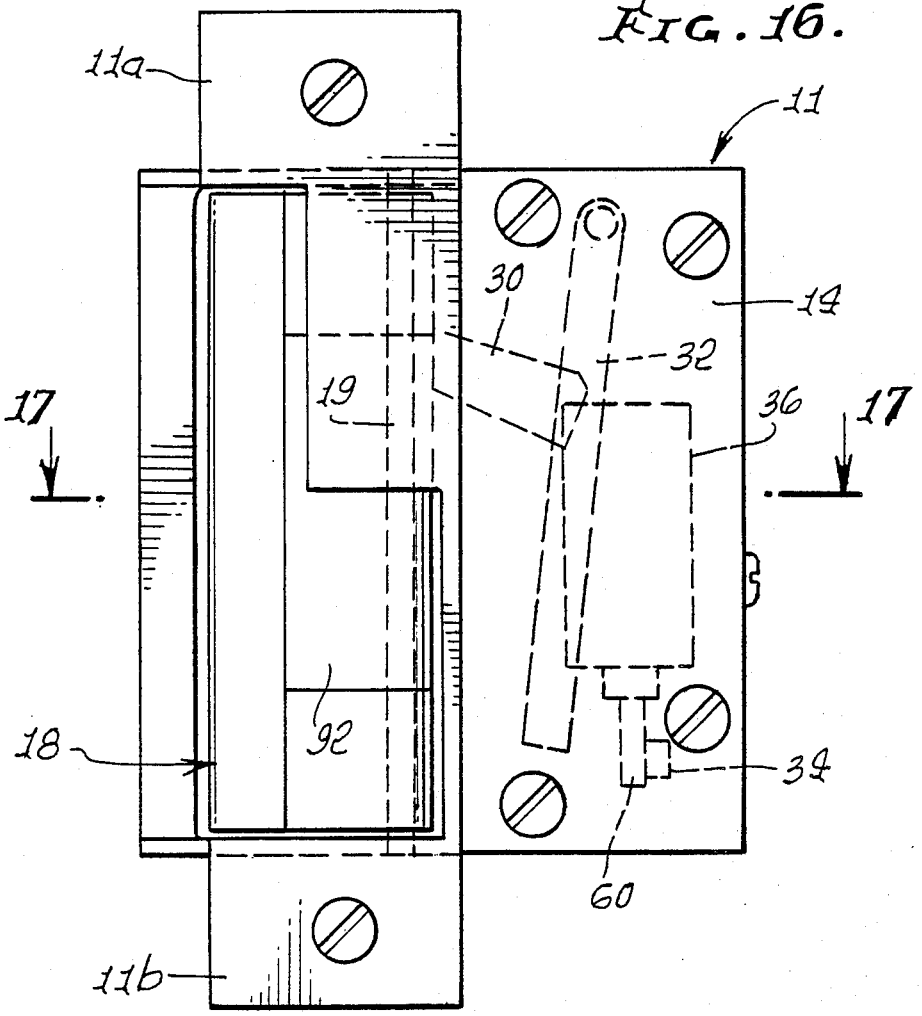
FIG. 16 is a view like FIG. 9 but showing use of a modified bolt.
Figure 17:
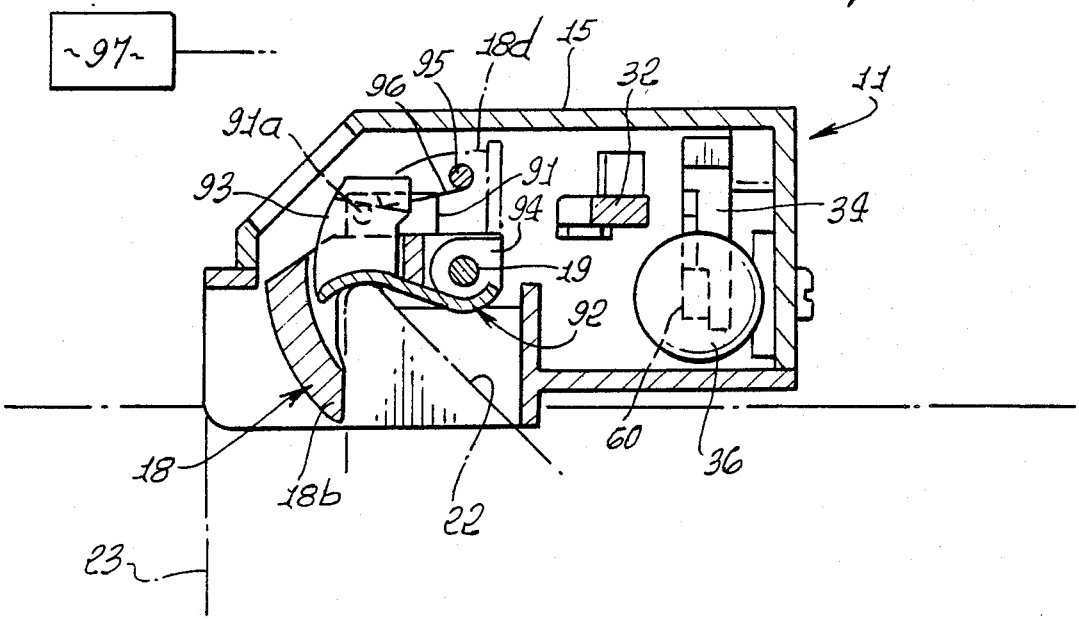
FIG. 17 is a horizontal section taken on lines 17—17 of FIG. 16, the device shown in locked condition.

As shown in FIGS. 1 and 2, device 10 includes a latch case or carrier frame 11 having top and bottom walls 12 and 13, front and rear walls 14 and 15, and left and right side walls 16 and 17. The case may have flanges or tabs **11*a* and 11*b* to be attached as by fasteners 81 and 81' to a door frame. A vertically elongated strike bolt 18 is pivotally attached to the case, as by a vertically elongated pin 19 received through an opening in bolt flange or flanges 18c. Opposite ends of the pin are retained in case openings 20 and 21 (see FIG. 8), and the rearside of the bolt is recessed at 18a to receive the pin, as seen in FIG. 2, whereby the bolt pivots about the vertical axis of the pin between locked condition as seen in FIG. 2, and unlocked condition as seen in FIG. 4**.

Figure 7:
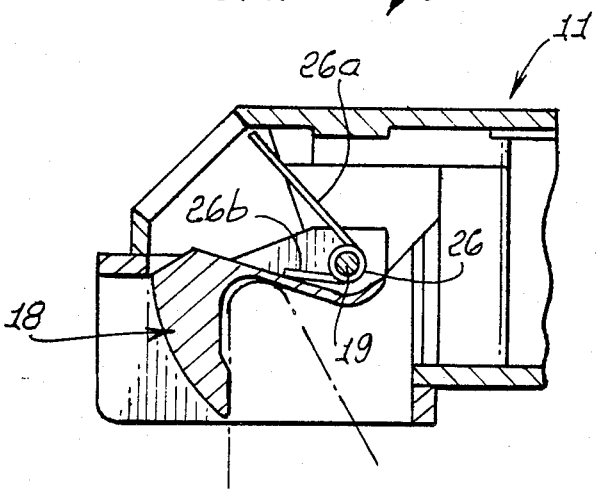
FIG. 7 is a horizontal section taken on lines 7—7 of FIG. 1.

In locked condition, the hook 18b of the bolt overlaps a part 22 in a door 23 to prevent swinging of the door in a direction 24. In inwardly swung, retracted bolt position, as seen in FIG. 4, the overlap of the hook 18b and part 22 is removed, so that the door can then swing in direction 24. A torsion spring 26 is wrapped about pin 19 to yieldably urge the bolt toward locked position as seen in FIGS. 1 and 2. One arm 26a of the spring 26 bears against the case, and the other arm 26b bears against the bolt. See FIG. 7.

Means including three arms, and a solenoid, are provided within the case to release the strike bolt for pivoting between locked and unlocked positions, as referred to. Such arms are tabulated as follows:

1. A first (blocking) arm, as at 30, pivotally connected to the case by pin 31, and movable counterclockwise (for example) from a first position (see FIG. 1) blocking bolt pivoting to a second position (see FIG. 3) allowing (i.e. unblocking) bolt pivoting to FIG. 3 position, which in turn allows door opening;
2. a second (release) arm, as at 32, pivotally connected to the case by pin 33, and movable (counterclockwise for example) from a primary position (see FIG. 1) in which it holds the first arm in its first position, to a secondary position on (see FIG. 3) in which the arm 32 then allows first arm movement to its second position; and
3. a third (trip) arm, as at 34, pivotally connected to the case by pin 35, and movable by downstroking of a plunger 36a from an initial position (see FIG. 1) in which it holds the second arm 32 in primary position, to a subsequent position (see FIG. 3) in which it allows movement of the second arm to its secondary position, as referred to.

Figure 3:
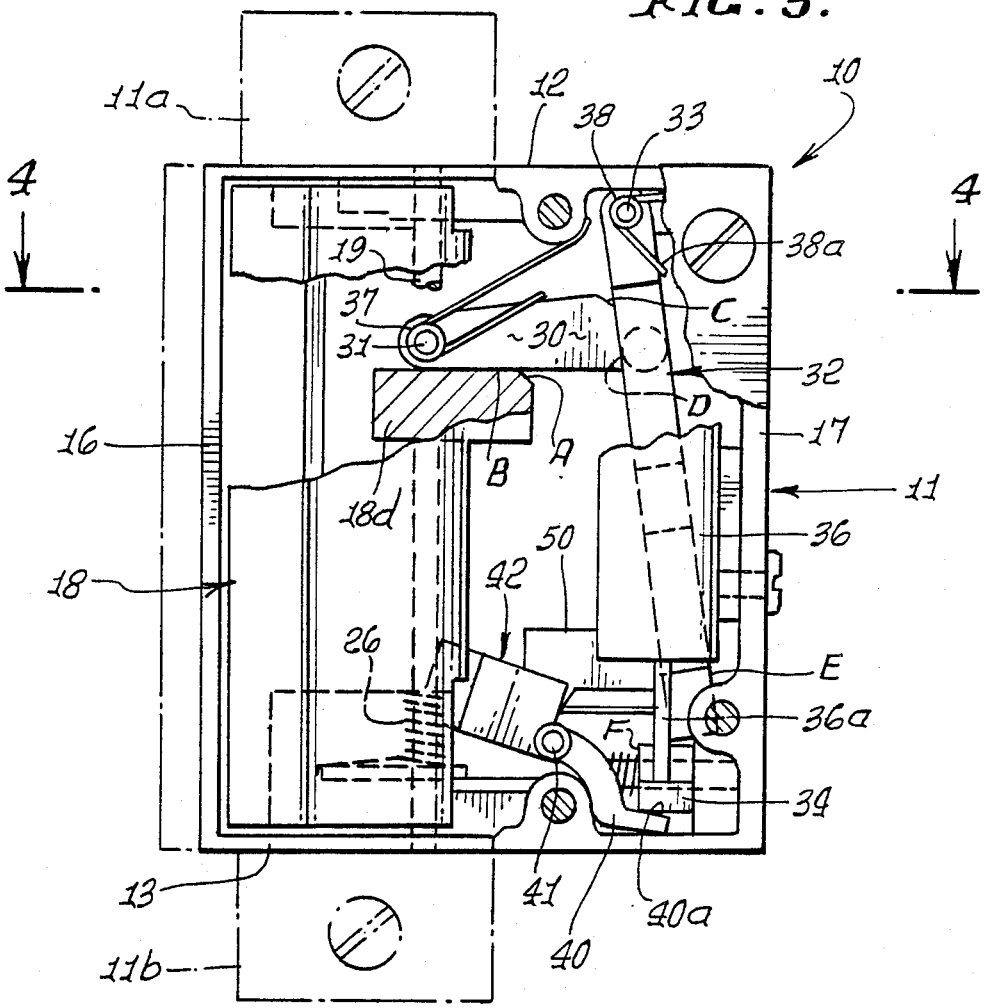
FIG. 3 is a view like FIG. 1 showing the device of unlocked condition.

Note that axis about which arms 30 and 32 pivot are normal to the plane of FIG. 1, whereas the axis about which arm 34 pivots is parallel to the plane of FIG. 1. Also note the following:

(i) The bolt and the first arm 30 have interengaged cam surfaces A and B in FIG. 1, these surfaces being relatively displaced in FIG. 3 (i.e. as arm 30 pivots up, it allows bolt flange 18d to move relatively rightwardly in FIG. 3) as the bolt pivots about pin 19;

(ii) the first arm 30 and the second arm 32 have interengaged cam surfaces C and D in FIG. 1 (surface D being on a trunnion 32b on arm 32), these surfaces being relatively displaced in FIG. 3 (i.e. arm 32 is driven rightwardly) by arm 30 as it is pivoted upwardly, under the influence of bolt cam surface A; a torsion spring 37 coiled about pin acting to urge arm 30 downwardly. See spring leg 37a bearing on the arm 30, and leg 37b bearing on the case. (Leg 38a of torsion spring 38 urges arm 32 leftwardly.)

(iii) the second arm 32 and the third arm 34 have interengaged cam surfaces E & F in FIG. 1 (surface F being on a flange 34d on arm 34), these surfaces being relatively displaced in FIG. 3 (i.e. arm 34 is pivoted downwardly by the solenoid plunger 36a to allow arm 32 to pivot rightwardly, in FIG. 3. Arm 34 is yieldably held upward in FIG. 1 by a torsion spring 80 best seen in FIG. 6, and an arm 40, to be described later, holds arm 34 in an upward position in the event of failure of the torsion spring 80. Note that a counterweighted arm functions as described only when the device is positioned as shown; i.e., when the device is installed in a position rotated 180 degrees in a vertical plane (or upside down), the arm 40 becomes inactive. In the event of failure of the torsion spring, in the position, the weight of the trip arm 34 will keep the device in locked mode, except when the solenoid is energized.

It is clear from the above that the provision of these arms allows a solenoid 36 of lightweight construction to control movement of a heavy-duty bolt, for a door, as for example a building door, the three arms located in very compact relation in a small case 11. Solenoid 36 is movable within the case, and extends upright, as to bolt 18 and arm 32. Thus, the mechanism operates in a "fail secure" mode, i.e., the solenoid operates to allow the door to be opened. These advantages are further enhanced in view of the following features of construction:

the first arm 30 has its pivot axis (the axis of pin 31) closer to the cam surfaces A and B in FIG. 1, than to the cam surfaces C and D;

the second arm 32 has its pivot axis (the axis of pin 33) closer to the cam surfaces C and D than to the cam surfaces E and F, in FIG. 1;

the cam surfaces C and D are proximate one end (upper end) of arm 32; and the surfaces E and F are proximate the opposite (lower) end of arm 32.

Figure 5:
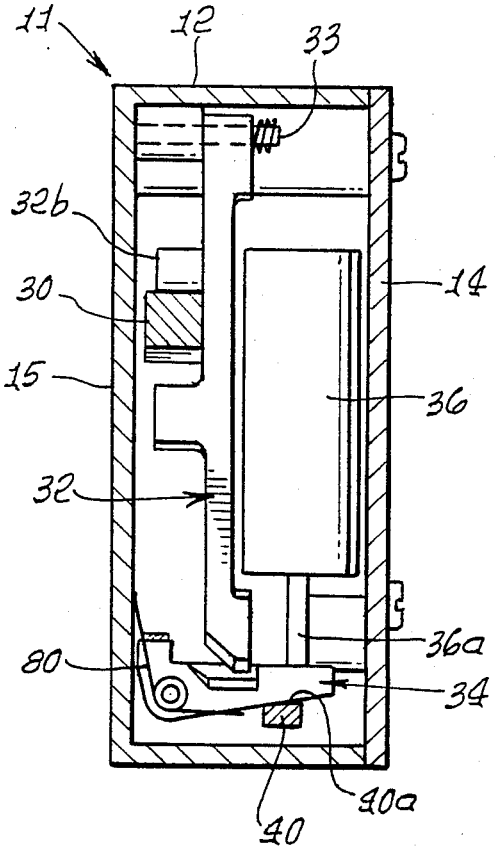
FIG. 5 is a section taken in elevation on lines 5—5 of FIG. 2.
Figure 6:
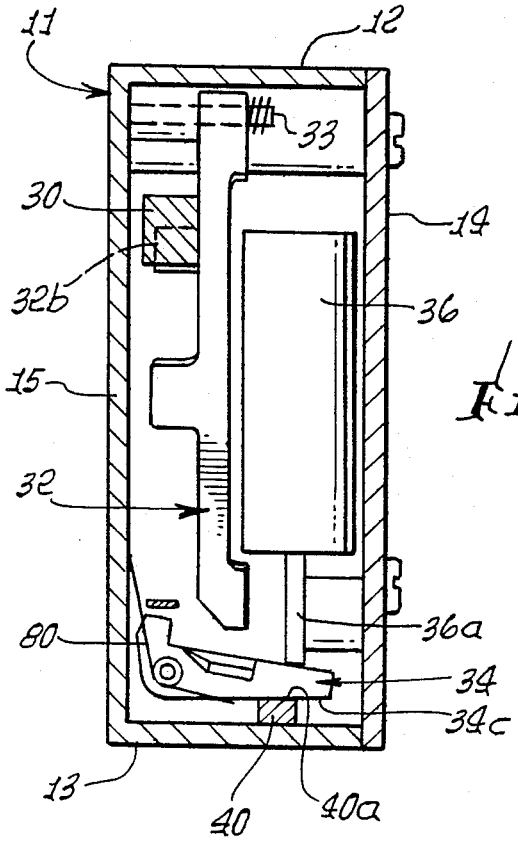
FIG. 6 is a section taken in elevation on lines 6—6 of FIG. 4.

As referred to above, a counterweighted arm 40 holds trip arm 34 in an upper position, as better seen in FIG. 5 in the event of failure of torsion spring 80. FIG. 6 shows arm 34, and arm 40, pivoted downwardly by the solenoid plunger 36a. Arm 40 is pivotally connected, as by a pin 41, to the case 11, and a counterweight 42 urges arm extension 40a downwardly (see FIG. 1), within the case. Thus, arm 40 pivots about a horizontal axis. The counterweight 42 is raised, in FIG. 3. The arm 40 has an upper surface 40a engaging the undersurface 34c of arm 34. See FIG. 5.

An electrical switch 50 on the case is operable to send a signal to a remote receiver (as at 81) which indicates that the solenoid is energized, and that the door is in an unlocked mode.

The elements of the structure seen in FIGS. 9–19 that correspond to elements in FIGS. 1–8 bear the same numerals; however, note the absence of counterweighted arm 40. The FIGS. 9–19 modified device is constructed to be mechanically operable in the event the solenoid 36 is inoperable, as for example might occur due to a current failure. As best seen in FIGS. 13 and 15, a pull rod 60 is pivotally attached to the trip (third) arm 34, as by a fastener pin 61, and is connected to the solenoid armature. Thus, the solenoid, when electrically energized, holds the trip arm 34 "up", and the parts are then in locked condition (see FIGS. 9 and 13). If electrical energization of the solenoid fails for any reason, the solenoid armature drops, gravitationally, rod 60 therefore drops, and the trip arm 34 is displaced downwardly, releasing arms 30 and 32 to operate in fail-safe mode, i.e. the bolt may be rotated to allow door opening. See FIGS. 11 and 14. The solenoid may be replaced by other type electrical actuators.

In FIGS. 16–19, the structure is generally the same as in FIGS. 1–4, with the following exceptions: bolt 18 carries an actuating plate 92 engagable by the door part 22, the plate pivoted by pin 19. A contact arm 93 on the plate protrudes as shown to engage or otherwise interact with a contact 91*a* on switch element 91 carried on the bolt 18, as the bolt pivots to FIG. 17 (door closed) position. Switch actuation signals a remote station 97, via a line 98, to indicate that the door is closed. A spring 96 attached by pin 95 to a boss 18*d* on the bolt, urges the plate to swing relative to the bolt and out of engagement with contact 91*a* in FIG. 18, when the door is opened. Thus, provision is made for remote sensing of door open and closed conditions. Switch elements 91*a* and 91 may be considered as a sensor, and plate 52 may be considered as an actuator.

I claim:

1. In an electrical release door strike, the combination comprising (a) a carrier frame, (b) a strike bolt carried by the frame for pivoting when released, allowing door opening, the bolt adapted to receive a door and resist door opening force prior to said pivoting, (c) means carried by the frame to release the strike bolt for such pivoting, including first, second and third arms, (d) the first arm movable from a first position blocking bolt pivoting to a second position allowing bolt pivoting to in turn allow said door opening, the second arm movable from a primary position in which it holds the first arm is said first position to a secondary position in which it allows first arm movement to said second position, and the third arm movable from an initial position in which it holds the second arm in said primary position to a subsequent position in which it allows movement of the second arm to said secondary position, and (e) including a solenoid carried by the frame to be operatively connected with the third arm, and wherein said third arm has a pivot axis about which it is pivotable in response to operation of the solenoid, the solenoid extending alongside the second arm, (f) and the solenoid having an armature pivotally connected to the third arm at a locus below the solenoid to hold the third arm in its initial position when the solenoid is energized, the armature adapted to drop to displace the third arm to its subsequent position in the event the solenoid becomes de-energized, (g) the solenoid having an upright axis, the third arm axis of pivoting extending generally horizontally in spaced relation to said solenoid upright axis, the third arm extending away from said axis of pivoting, and to a location beneath the solenoid, proximate said solenoid axis, the third arm releasably connected to the second arm at a location along the third arm between said axis of pivoting of the third arm and said locus.

2. The combination of claim 1 wherein the third arm initial position is an "up" position and the third arm subsequent position is a "down" position, and wherein the solenoid, when energized holds said third arm in said "up" position, whereby said bolt then resists door opening force.

3. The combination of claim 2 wherein the third arm has said "down" position when the solenoid is de-energized, the bolt then allowing door opening.

* * * * *